US008584841B1

(12) United States Patent
Tiegs

(10) Patent No.: US 8,584,841 B1
(45) Date of Patent: Nov. 19, 2013

(54) CONTAINER

(71) Applicant: Gregory D. Tiegs, Kennewick, WA (US)

(72) Inventor: Gregory D. Tiegs, Kennewick, WA (US)

( * ) Notice: Subject to any disclaimer, the term of this patent is extended or adjusted under 35 U.S.C. 154(b) by 0 days.

(21) Appl. No.: 13/668,944

(22) Filed: Nov. 5, 2012

(51) Int. Cl.
*B65D 69/00* (2006.01)

(52) U.S. Cl.
USPC ..... 206/232; 206/38.1; 206/37.4; 206/471; 220/555

(58) Field of Classification Search
USPC ..... 206/232, 38.1, 37.1–37.8, 471, 387.14, 206/474–475, 449, 564, 580, 58, 775, 778, 206/470; 220/500, 555, 520
See application file for complete search history.

(56) References Cited

U.S. PATENT DOCUMENTS

| | | | | |
|---|---|---|---|---|
| 2,893,546 | A | 7/1959 | Kendall et al. | |
| 3,463,309 | A * | 8/1969 | Szostek | 206/470 |
| 3,710,975 | A | 1/1973 | Jansen | |
| D229,549 | S | 12/1973 | Mascetti, Jr. | |
| 4,037,716 | A * | 7/1977 | Marks | 206/38 |
| 4,285,461 | A * | 8/1981 | Meyers | 229/123.2 |
| 4,619,364 | A | 10/1986 | Czopor, Jr. | |
| 4,749,082 | A | 6/1988 | Gardiner et al. | |
| 4,829,691 | A | 5/1989 | Manjos et al. | |
| 4,878,579 | A * | 11/1989 | Hager | 206/0.84 |
| 4,901,547 | A * | 2/1990 | Dal Palu' | 70/408 |
| 4,946,030 | A * | 8/1990 | Guridi et al. | 206/37.1 |
| 5,042,650 | A * | 8/1991 | Mayer et al. | 206/0.84 |
| 5,540,324 | A * | 7/1996 | Knapp | 206/6.1 |
| 5,584,387 | A * | 12/1996 | Grant | 206/216 |
| 5,653,335 | A | 8/1997 | Bauer et al. | |
| 5,791,482 | A | 8/1998 | Murphy et al. | |
| 5,864,013 | A * | 1/1999 | Goldberg | 530/350 |
| 5,865,307 | A * | 2/1999 | Friedman | 206/37.1 |
| 5,984,091 | A * | 11/1999 | Orr et al. | 206/232 |
| 6,039,495 | A * | 3/2000 | Zimmerman et al. | 402/79 |
| 6,047,819 | A | 4/2000 | Borst et al. | |
| 6,047,820 | A * | 4/2000 | Heinze, IIII | 206/232 |
| 6,126,008 | A | 10/2000 | Cox | |
| 6,216,866 | B1 | 4/2001 | Schoenberg | |
| 6,766,906 | B2 | 7/2004 | Charng | |
| 7,556,152 | B2 * | 7/2009 | Lechelle | 206/581 |
| 7,597,250 | B2 * | 10/2009 | Finn | 235/380 |
| D615,320 | S | 5/2010 | Griffin | |
| 8,003,116 | B2 | 8/2011 | Dobler | |
| 8,011,510 | B1 | 9/2011 | Smith, II et al. | |
| 8,079,470 | B2 * | 12/2011 | Trajkovich | 206/387.13 |
| 8,381,908 | B2 * | 2/2013 | Hansen et al. | 206/470 |
| 2003/0038042 | A1 * | 2/2003 | Nagata et al. | 206/232 |
| 2004/0026275 | A1 * | 2/2004 | Margetts et al. | 206/308.1 |
| 2005/0173286 | A1 * | 8/2005 | Hansen | 206/472 |
| 2008/0023343 | A1 * | 1/2008 | Macor | 206/81 |
| 2008/0023351 | A1 * | 1/2008 | Macor | 206/232 |
| 2008/0116088 | A1 * | 5/2008 | Roberts | 206/232 |
| 2008/0127926 | A1 * | 6/2008 | Kim | 123/179.2 |
| 2008/0230402 | A1 * | 9/2008 | Macor | 206/81 |

* cited by examiner

*Primary Examiner* — J. Gregory Pickett
*Assistant Examiner* — James Way
(74) *Attorney, Agent, or Firm* — Paine Hamblen, LLP

(57) ABSTRACT

A container is described and which includes a first, substantially transparent base portion, and a second substantially transparent base portion, which is hingedly mounted to the first base portion, and wherein the first base portion defines an internal cavity for enclosing individual objects of interest, and wherein the container is fabricated in a manner whereby the objects of interest may be visually inspected from their opposite sides, and wherein the container further has a thickness dimension which permits the container be accepted and delivered by the Postal Service.

1 Claim, 9 Drawing Sheets

CONTAINER

TECHNICAL FIELD

The present invention relates to a container, and more specifically, to a rigid, transparent container for holding, and displaying objects of interest, and more specifically to a container which is suitable for acceptance and delivery by the U.S. Postal Service and other similar agencies.

BACKGROUND OF THE INVENTION

Various containers, mailing pouches and other flexible enclosures have been developed through the years for enclosing various objects of interest such as printed subject matter, and other physical objects, and which are acceptable for delivery through various mailing and package processing and delivery agencies. As a general matter, for such packages to be accepted and delivered by the U.S. Postal Service, the packages have to have limited physical sizes, and must have a thickness dimension which permits them to be effectively handled by employees of that agency.

Various business vendors have endeavored, over time, to develop various mailing packages, pouches and other containers, which allow them to display a commercial message, or images of their goods in a manner which is both attractive, and pleasing to the consumer, and which further permits the consumer to quickly become familiar with the goods or services being offered by the vendor. As of late, vendors have attempted to increase the amount of consumer interest in their respective businesses by providing various business and personal incentives, such as games of chance, to encourage potential consumers to visit and purchase goods or services from them. Oftentimes, these enticements to visit a specific business includes rather appealing rewards, such as credit, debit or gift cards; meals at local restaurants; free clothing; and even including the possibility of receiving a free automobile if the consumer would visit the business and, for example, test drive a vehicle of their choice.

In this regard, such consumer enticements have often been in the form of printed circulars, handbills and the like. However, such printed circulars have often not received very favorable consumer return rates because such printed advertising is often largely discounted or ignored, and then immediately discarded by the consumers when they receive and review their daily mail. To enhance the likelihood of consumer participation in offerings such as this, vendors, and other business owners have looked for other mailing packages which would tend to encourage the consumer to read the advertising provided in the mailing package, and which would further entice the consumer to visit the business, such as an automobile dealership, for example, in order to possibly win the reward offered by the advertising in the event that they visited the business.

A container which encloses objects of interest, and which addresses the perceived needs of vendors, as discussed above, is the subject matter of the present application.

SUMMARY OF THE INVENTION

A first aspect of the present invention relates to a container which includes a first, substantially transparent base portion defining three discrete compartments for enclosing individual objects of interest, and wherein each object of interest has opposite sides; and a second, substantially transparent top portion which is hingedly mounted to the first base potion, and which releasably, sealably cooperates with the first, base portion, and which defines an internal cavity for enclosing the individual objects of interest so that the opposite sides of the respective objects of interest may be visually inspected, and wherein the container has a closed configuration having a resulting thickness which permits the container to be accepted for delivery by the Postal Service.

Still another aspect of the present invention relates to a container which includes a first portion defined by a main body which has a peripheral edge, and which further defines first, second, and third compartments, and wherein the main body also defines a circumscribing sidewall which is located in spaced relation relative to the peripheral edge, and which further defines a circumscribing channel, and wherein the first compartment is rectangular shaped; the second compartment is shaped like a key; and the third compartment is rectangular shaped, and wherein the main body further defines a pair of coupling passageways which are formed in the second compartment, and wherein a multiplicity of objects of interest are individually received in the first, second, and third compartments; and a second portion is hingedly mounted to the first portion, and which is moveable between a first position which permits access to the first, second, and third compartments defined by the first portion, and a second position, where the first and second portions are in a closed configuration, and which prevents removal of the objects of interest from the container, and wherein, in the closed configuration, the container has a thickness dimension of less than about 0.25 inches, and wherein the second portion has a main body which defines a male engagement member which is operable to matingly engage the circumscribing channel defined by the first portion when the first and second portions are in the closed configuration, and wherein the main body of the second portion has first, second, and third engagement members which are operable to cooperate with the first portion of the container to facilitate the securing of the first and second portions in releasable cooperation, together, and which further substantially impairs any movement of the objects of interest which are enclosed within the first, second, and third compartments.

These and other aspects of the present invention will be discussed in greater detail hereinafter.

BRIEF DESCRIPTION OF THE DRAWING

Preferred embodiments of the present invention are described, below, with reference to the following accompanying drawings.

DETAILED DESCRIPTION OF THE PREFERRED EMBODIMENTS

This disclosure of the invention is submitted in furtherance of the constitutional purposes of the U.S. Patent laws "to promote the progress of science and useful arts." (Article I, Section 8).

Figure 1:
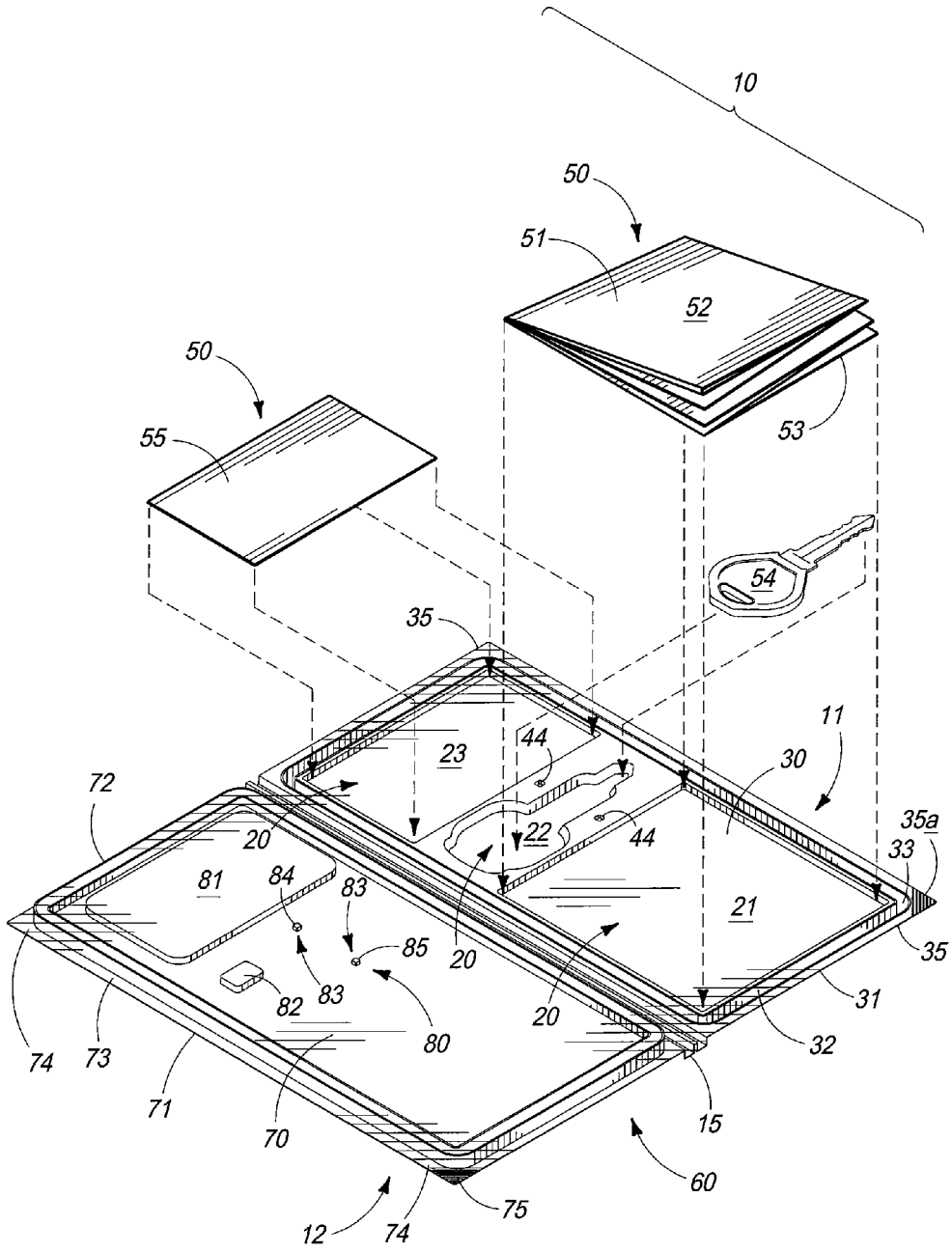
FIG. 1 is perspective, exploded, plan view of the novel container of the present invention.
Figure 2:
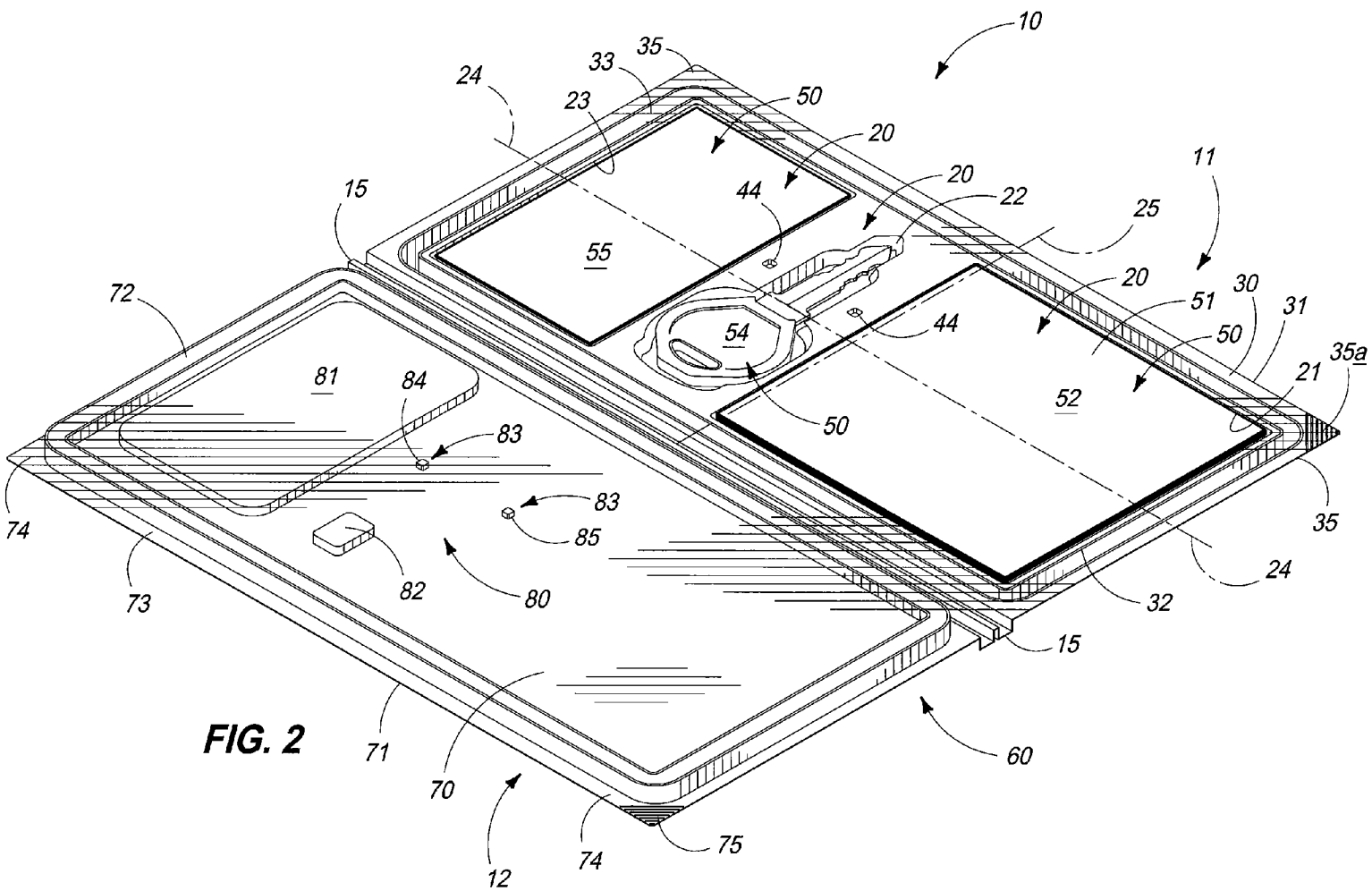
FIG. 2 is a second, perspective view of the novel container and which shows several objects of interest placed within the novel container.
Figure 5:
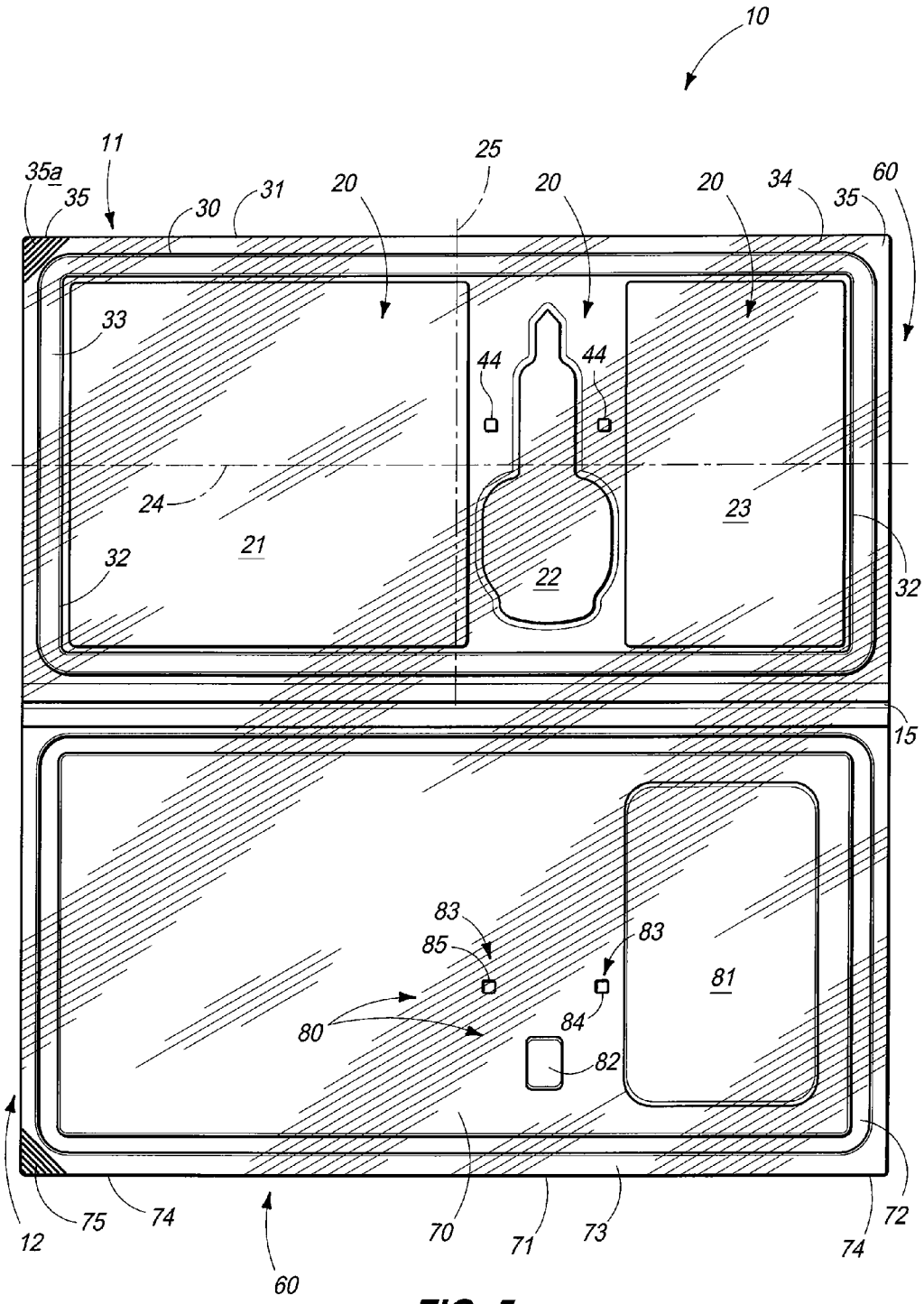
FIG. 5 is an exterior, top plan view of the novel container displayed in an open configuration.
Figure 6:
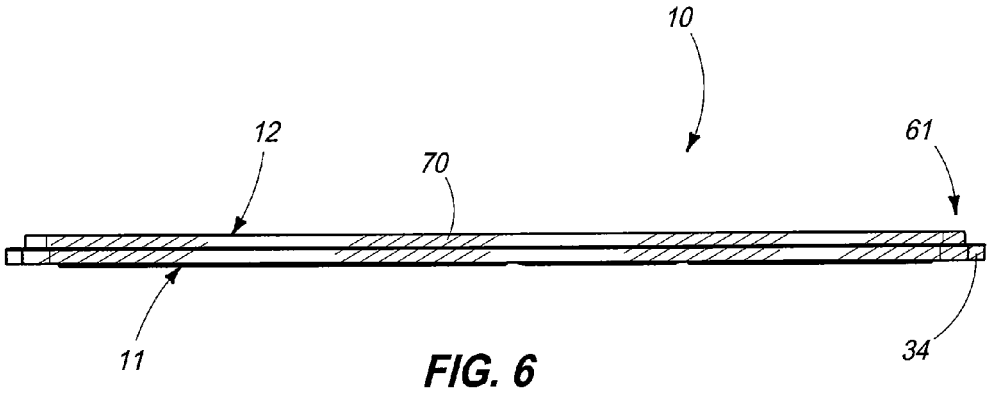
FIG. 6 is an end view of the novel container, and which is displayed in a closed configuration.
Figure 7:
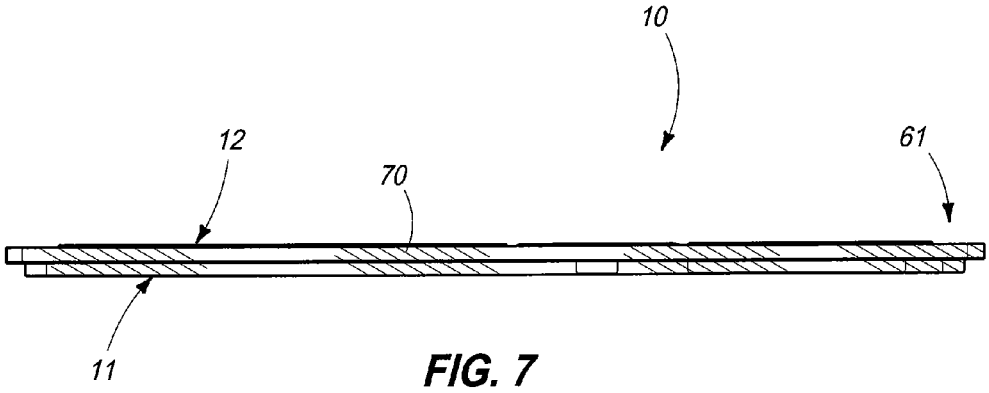
FIG. 7 is a second, end view of the novel container, and which is displayed in a closed configuration, and which is further taken from a position opposite to that seen in FIG. 6.
Figure 8:
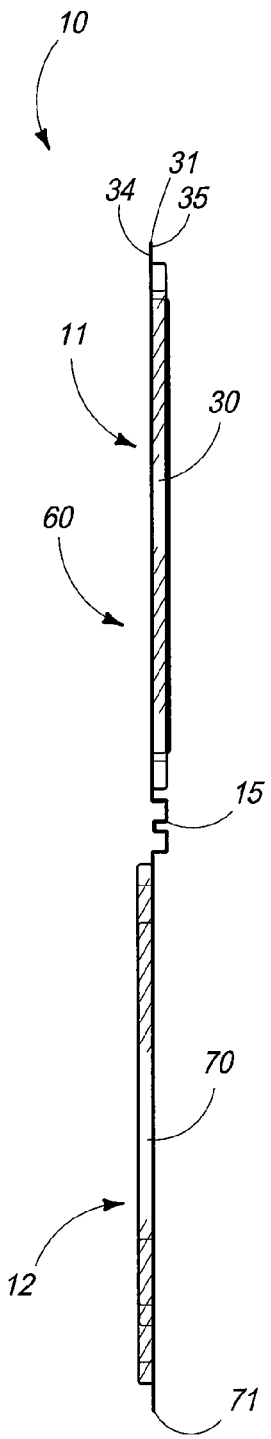
FIG. 8 is an end view of the novel container and which is displayed in an open configuration.
Figure 9:
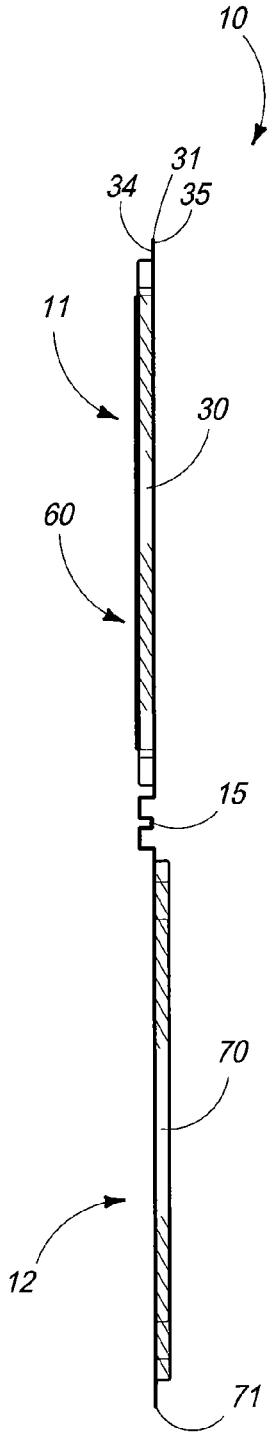
FIG. 9 is a second end view of the novel container and which is displayed in an open configuration and which is taken from a position opposite to that which is seen in FIG. 8.
Figure 10:
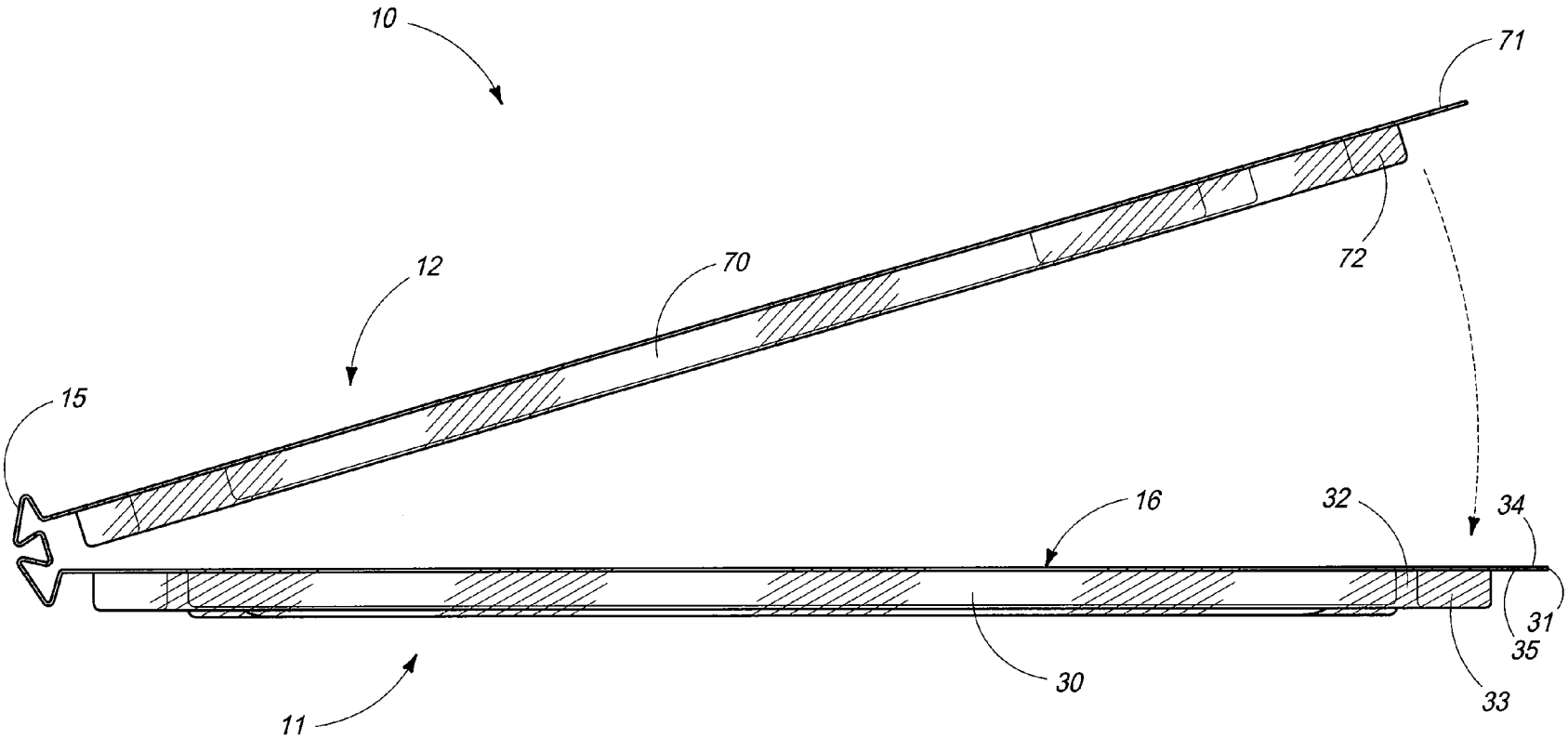
FIG. 10 is an enlarged, end view of the novel container and which displays the movement of the respective portions, one relative to the other.
Figure 11:
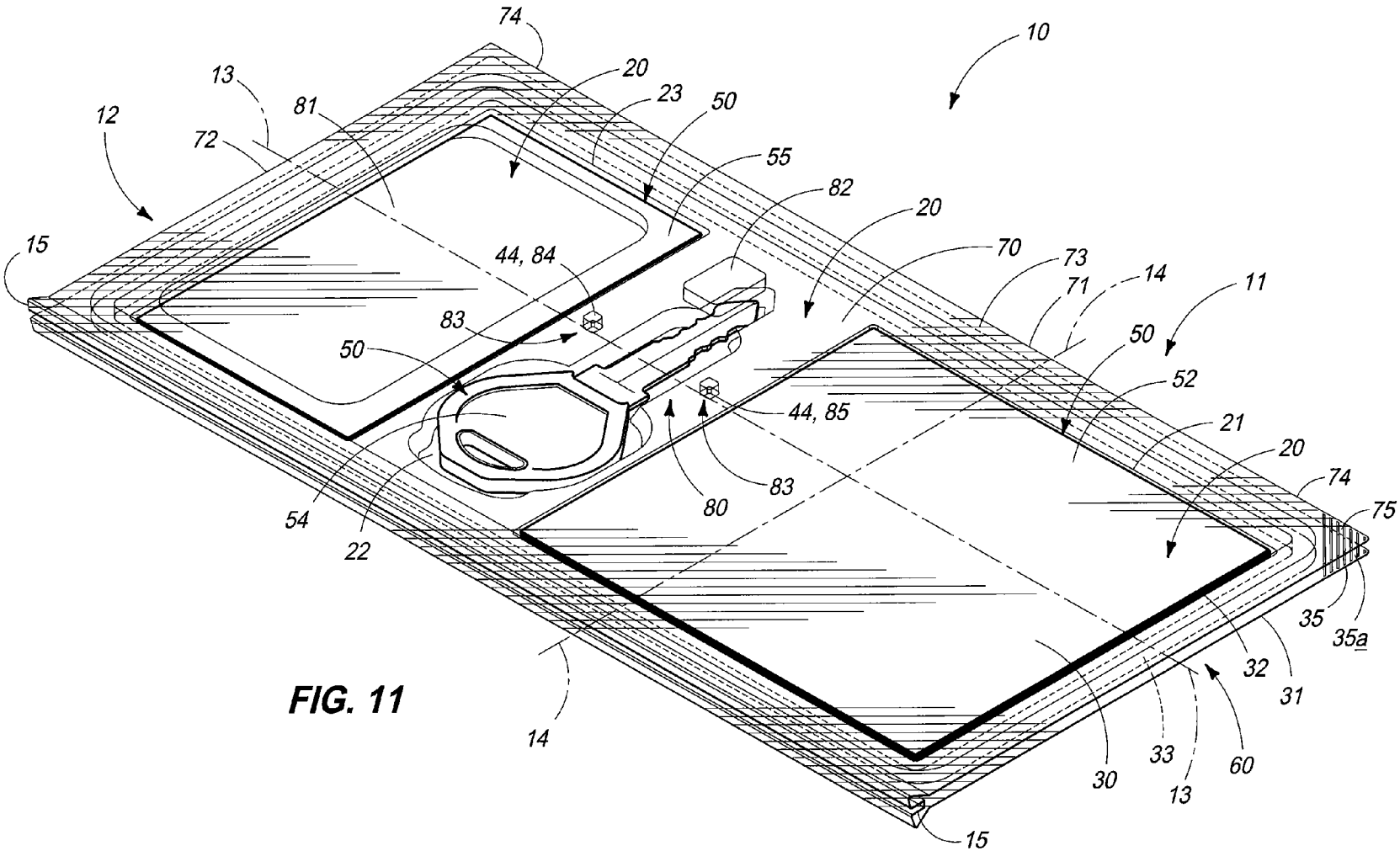
FIG. 11 is a top plan view of the novel container and which displays the container in a closed configuration.

A container which may be used by a vendor for promoting their respective goods or services is generally indicated by the numeral 10 in FIG. 1, and following. As seen in the attached drawings, the container 10 comprises first and second portions, 11 and 12, respectively, which are hingedly affixed together, and which further are fabricated from a thermomoldable and substantially transparent substrate. The container 10, which is rigid, and when placed in a closed configuration (FIGS. 6 and 7), is narrowly rectangular and is defined, at least in part, by a longitudinal axis 13, and a transverse axis 14, (FIG. 11). Further, the first and second portions are coupled together by a hinge, which is generally indicated by the numeral 15. In the closed configuration (FIGS. 6 and 7), the container defines an internal cavity 16. As illustrated in the drawings (FIG. 2), the first portion 11 defines a multiplicity of compartments 20, which are defined, at least in part, by first, second and third compartments 21, 22 and 23, respectively. As seen in the drawings, the first portion 11 is defined, at least in part, by a longitudinal axis 24, and a transverse axis, which is generally indicated by the numeral 25 (FIG. 5). Additionally, the first portion 11 has a main body 30, which is defined by a peripheral edge 31. Additionally, it will be seen in the drawings that a circumscribing sidewall 32 extends normally upwardly from the main body 31, and is located in spaced relation relative to the peripheral edge 31. The sidewall 32 defines, in part, a circumscribing channel 33, having a predetermined depth, and which is operable to matingly cooperate with a feature of the second portion 12, as will be discussed in the paragraphs which follow. Further, it will be seen in the drawings that a narrow, circumscribing flange 34 is defined between the sidewall 32, and the peripheral edge 31. As the drawings show, the first portion 11 is narrowly rectangular, and therefore the flange 34 defines, at least in part, two, opposite corners 35. In the arrangement as seen in the drawings, at least one of the corners of the first portion 11 is weakened 35A in a manner which allows the corner 35 to be easily bent upwardly or downwardly. This feature allows a consumer to use their fingers to easily grasp the distorted corner, and which facilitates the opening of the container 10.

Figure 3:
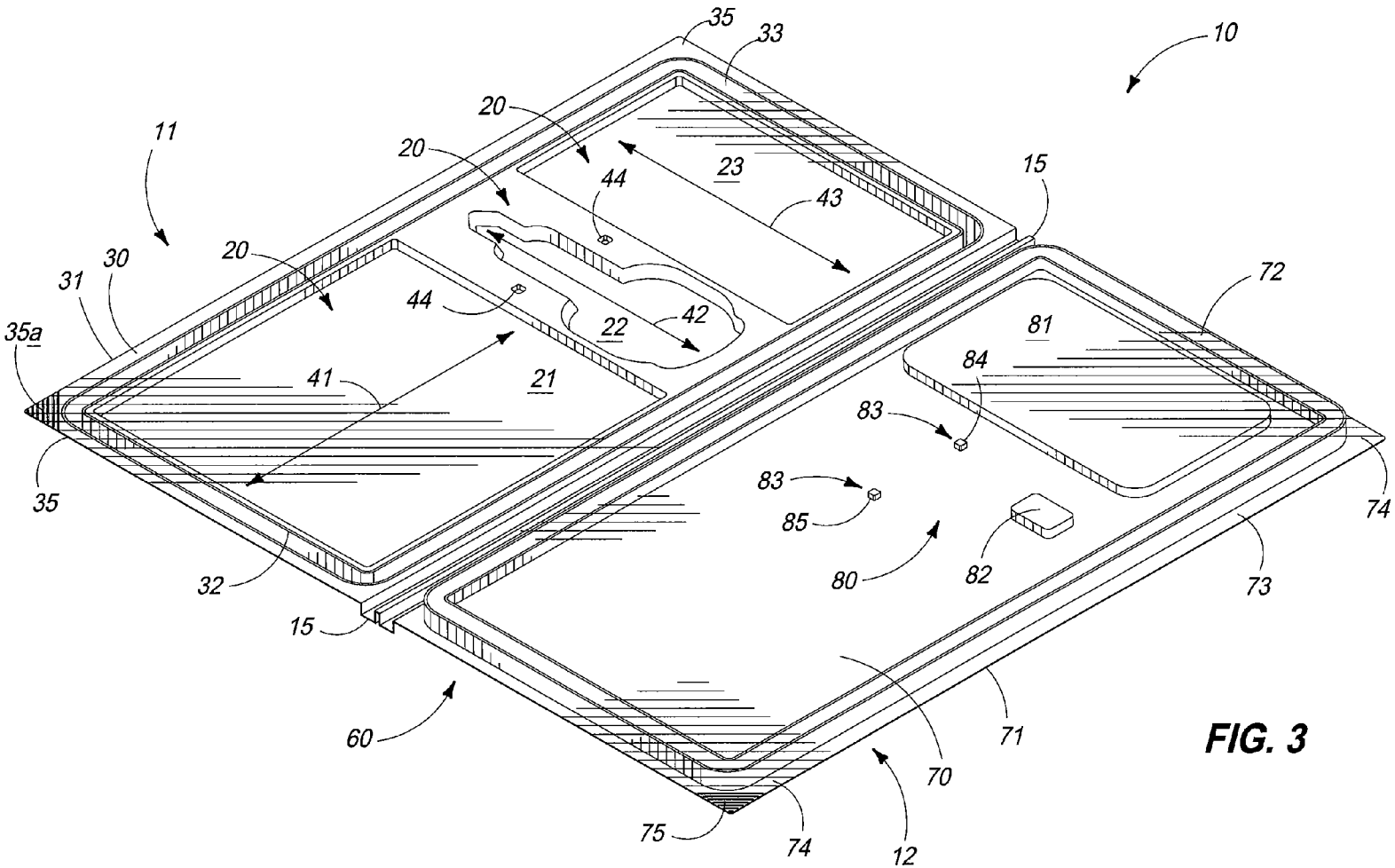
FIG. 3 is perspective, plan view of the novel container displayed in an open configuration.
Figure 4:
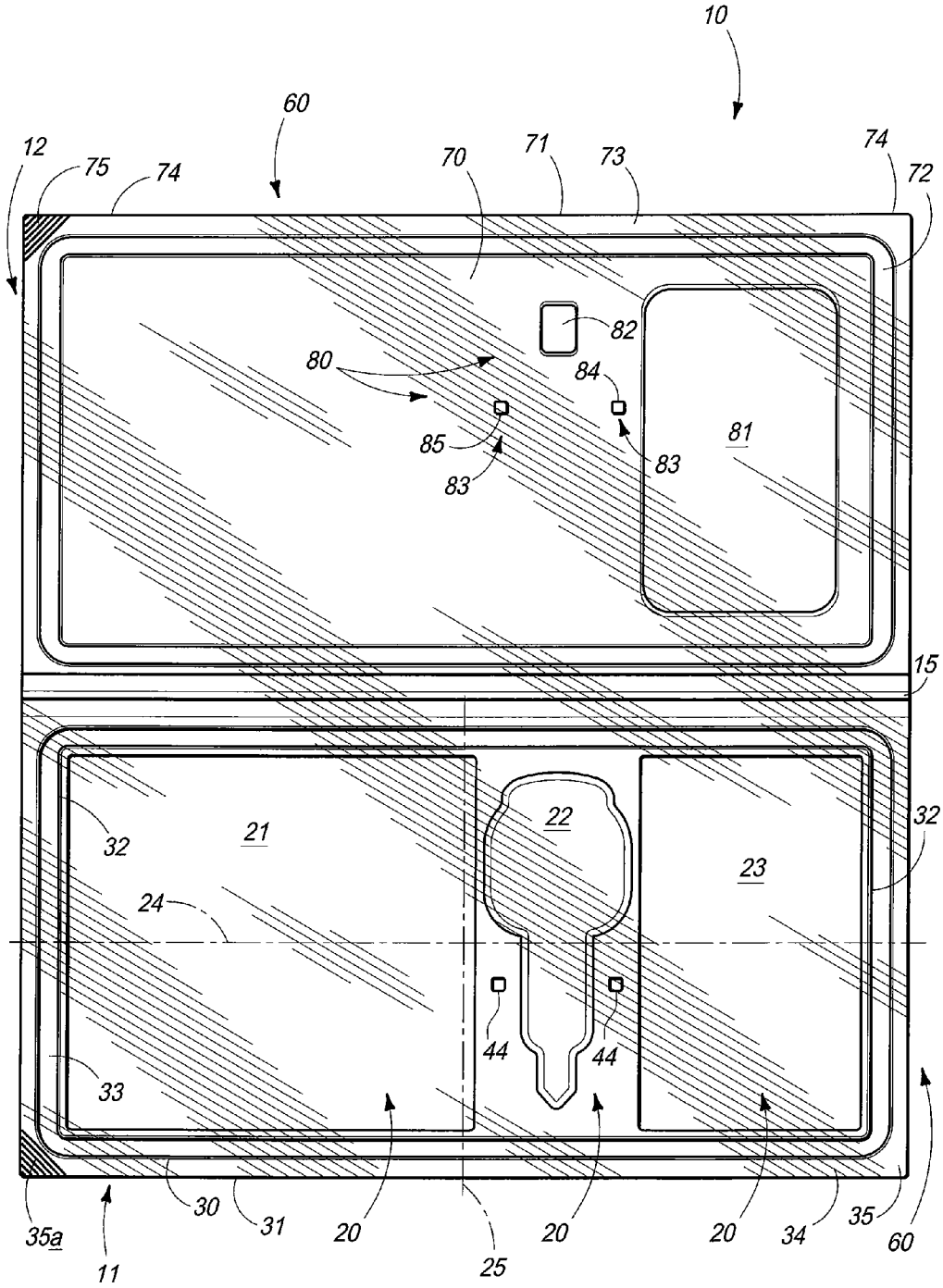
FIG. 4 is an interior, top plan view of the novel container displayed in an open configuration.

As seen in the drawings (FIGS. 3 and 4), the first portion 11, and more specifically the first compartment 21 that is formed therein, is defined, at least in part, by a longitudinal axis which is generally indicated by the numeral 41. As seen in the drawings, the first compartment 21 is rectangular, and has a length dimension of less than about 4.2 inches, and a width dimension of less than about 3.6 inches. As seen in the drawings, the longitudinal axis 41, of the first compartment 21, is substantially coaxially aligned with the longitudinal axis 24 of the first portion 11. Still further, the second compartment 22 is further defined by a longitudinal axis 42, which is disposed in substantially parallel, spaced relation relative to the transverse axis 25 of the first portion 11. Additionally, the third compartment 23 has a longitudinal axis 43, and which is disposed in substantially parallel, spaced relation relative to the transverse axis 25 of the first portion 11, and which is also transversely disposed relative to the longitudinal axis 41 of the first compartment 21. As seen in the drawings, the third compartment 23 has a length dimension of less than about 3.6 inches, and a width dimension of less than about 2.2 inches. Additionally, as will be noted in the drawings, the second compartment 22 is formed in the shape of a key, or other desired shape, and which will be described in greater detail, below. Additionally, and formed in the second compartment 22 is a pair of spaced, and discreet coupling apertures or passageways 44, which are operable to matingly engage the second portion 12, when the first and second portions 11 and 12 are brought together, in a closed, secured configuration, as will be described in greater detail, below.

The first substantially transparent base portion 11, and which defines three discreet compartments 21, 22 and 23, respectively, is operable to enclose individual objects of interest, and which are generally indicated by the numeral 50. The individual objects of interest include at least one piece of printed advertising 51, which has top and bottom surfaces 52 and 53; and a key 54 which could potentially fit an ignition of an overland vehicle, or other valuable object of interest. It should be appreciated that while a key, 54, is depicted in the drawings, other similar objects of interest could be placed in this same region, and which would be percieved by a reasonable consumer as a valuable item or object. These other potentially valuable objects of interest 54 could include, for example, a code case; an Intelli-key; or a promotional casino chip, not shown. The key 54, as depicted, is received in the second compartment 22. Further, a facsimile of a credit card, debit card or gift card, and which is generally indicated by the numeral 55, and which is received within the third compartment 23. The piece of printed advertising 51 may include multiple pages of advertising, depending upon the needs of a vendor. In any event, the opposite sides of each of the objects of interest 50 may be readily, visibly discernable through the transparent first base portion 11, and the second top portion 12, respectively. As seen in the attached drawings the printed advertising is depicted as being a folded, muti-page advertising insert which fits within the first compartment 21. However, the present invention 10 is operable to receive, and enclose a piece of printed advertising which is sized to be received within, and extend over, and be partially received within, each of the three previously described compartments, and which further extends along the entire longitudinal length of the container, 10.

In the arrangement as seen in the drawings, the novel container 10 has an open configuration which is generally indicated by numeral 60; and a closed configuration that is generally indicated by the numeral 61. In the closed configuration 61, the first and second portions 11 and 12 are releasably coupled together in a fashion whereby the resulting thickness of the container 10 is less than about 0.25 inches. Still further, the container 10, in the closed configuration 60, has a width of less than about 4.53 inches, and a length of about 8.65 inches. In the open configuration 60, the first and second portions, 11 and 12, have a length dimension of less than about 9.13 inches, and a width dimension of about 8.65 inches. In the closed configuration, the container 10 defines an internal cavity 63. The second, substantially transparent top portion 12 has a main body 70, which is defined by an outside facing, peripheral edge 71. The top portion 12, which is narrowly rectangular, further has formed therein a circumscribing male engagement member 72, which extends upwardly from the main body 70 and which is located in predetermined, spaced relation relative to the peripheral edge 71. The circumscribing male member 72 is dimensioned so as to be matingly received within the circumscribing channel 33, as defined by the main body 30 of the first portion 11. Between the circumscribing male engagement member 72, and the peripheral edge 71, is a flange region 73. The flange region further defines a pair of corners 74. One of the corners, which is generally indicated by a numeral 75, is weakened so as to provide a convenient means whereby the user may easily bend the weakened corner 75, upwardly or downwardly, so as to provide a gripping region for forcibly separating the first and second portions 11 and 12 when opening the container and placing it in an open configuration 60. As will be appreciated, and when placed in the open configuration 60, the objects of interest 50 may be easily removed, inspected, or considered, as may be required by a consumer.

As seen in the drawings, the second portion 12, and more specifically the main body 70 thereof, defines a multiplicity of engagement members which are generally indicated by the numeral 80. The multiplicity of engagement members include first, second and third engagement members 81, 82 and 83, respectively, and which each extend outwardly relative to the main body 70, thereof. The first engagement member 81 is dimensioned so as to nestingly or matingly fit within the third compartment 23, as defined by the first portion 11 of the container 10. The first engagement member 81 forcibly engages the facsimile of the credit card, debit card or gift card 55 which is received in the third compartment 23, so as to inhibit excessive movement of the facsimile credit, debit or gift card 55 when the container 10 is in the closed configuration 61. The second engagement member 82 similarly forcibly engages the key 54, which is received in the second compartment 22, as defined by the first portion 11 of the container 10. This second engagement member 82 also further inhibits excessive movement of the key 54 when the container 10 is in the closed configuration 61. Still further, the third engagement member 83 includes a pair of posts, here indicated by the numerals 84 and 85, respectively, and which are individually, matingly, received within the discreet coupling passageways 44, which are formed in the first portion 11 of the container 10. When received within the coupling passageways 44, the first and second posts 84 and 85, respectively, are operable to releasably secure, at least in part, the second portion 12 to the first portion 11, when the container is in the closed configuration 61. The combination of the mating receipt of the circumscribing male engagement member 72, within the circumscribing channel 33; and the first and second posts 84 and 85, within the pair of discreet coupling passageways 84, provide, in combination, sufficient frictional contact between the first and second portions 11 and 12, respectively, such that no adhesive sealant is necessary to keep the first and second portions 11 and 12 in the closed configuration 61, as the container moves through the Postal Service system and experiences routine handling. Consequently, upon receipt of the container 10, an average consumer by grasping the weakened corners 36 and 75, respectively, can pry or forcibly separate the first and second portions, thereby allowing easy access to the contents which include the multiplicity of objects of interest 50.

Operation

The operation of the described embodiment of the present invention is believed to be readily apparent, and is briefly summarized at this point.

In its broadest aspect, the present invention includes a novel, generally rigid container, which has a first, substantially transparent base portion 11, and which further defines three discreet compartments 21, 22 and 23, respectively, for enclosing individual objects of interest 50. Each of the objects of interest has opposite sides. In the present invention, the container 10 includes a second, substantially transparent top portion 12, which is hingedly mounted to the first base portion 11, and which releasably, sealably cooperates with the first base portion 11, and which defines an internal cavity 63 for enclosing the individual objects of interest 50, so that the opposite sides of the respective objects of interest may be visually inspected through the respective portions 11 and 12. The container 10 has a closed configuration 61, having a resulting thickness, which permits the container 10 to be accepted, and delivered by the Postal Service. In this regard, the resulting thickness is less than about 0.25 inches. As seen in the drawings, the first and second portions 11 and 12 are fabricated from a transparent, thermomoldable material in a clam-shell arrangement. Additionally, the three discreet compartments 21, 22 and 23, have different shapes. In this regard, the first and third compartments are rectangular in shape, and disposed in predetermined spaced relation, one relative to the other. The second compartment is located between the first and second compartments 21 and 22, and is further appropriately shaped so as to receive a suitable key, or other possibly valuable object of interest, 54, therein. In the arrangement as seen in the drawings, the first and third compartments 21 and 23 each have a rectangular shape, and a given cross-sectional area. The first compartment 21 further has a cross-sectional area which is larger than the cross-sectional area of the third compartment.

Another aspect of the present invention relates to a rigid container 10, which includes a first portion 11, which is defined by a main body 30, and which has a peripheral edge 31. The first portion 11 further defines first, second and third compartments 21, 22 and 23, respectively. The main body 31 defines a circumscribing sidewall 32, which is located in spaced relation relative to the peripheral edge 31, and which further defines a circumscribing channel 33. The first compartment 21 is rectangular in shape; the second compartment 22 is shaped like a key; and the third compartment 23 is rectangular in shape. The main body 31 further defines a pair of coupling passages 44, which are formed in the second compartment 22. A multiplicity of objects of interest 50 are individually received in the first, second, and third compartments 21, 22, and 23, respectively. The present invention 10 further includes a second portion 12, which is hingedly mounted to the first portion 11, and which is moveable between the first position 60, which permits access to the first, second and third compartments 21, 22, and 23, and which are defined by the first portion 11. Still further, the second portion 12 is moveable to a second position where the first and second portions 11 and 12 are in a closed configuration 61, which prevents the removal of the objects of interest 50 from the container 11. In the closed configuration 61, the container 11 has a thickness dimension of less than about 0.25 inches. The second portion has a main body 70, which defines a male engagement member 72, and which is operable to matingly engage the circumscribing sidewall 32, which is defined by the first portion 11, when the first and second portions 11 and 12 are in the closed configuration 61. The main body 70, of the second portion 12, has first, second and third engagement members 81, 82 and 83, respectively, and which are operable to cooperate with the first portion 11 of the container 10 so as to facilitate the securing of the first and second portions 11 and 12, in releasable cooperation, together, and which further substantially impairs or restricts any excessive movement of the objects of interest 50, which are enclosed within the first, second and third compartments 21, 22 and 23, respectively.

Therefore, it will be seen that the present invention provides a convenient means whereby a vendor or business owner may display objects of interest to a potential customer or consumer, in a manner not possible heretofore. Still further, the present container is easy to open, and further may be accepted, and delivered by the Postal Service. The present novel container displays various objects of interest in a noteworthy manner, and which is attractive to consumers and which further encourages a consumer to consider or utilize the objects contained therein.

In compliance with the statute the invention has been described in language more or less specific as to structural and methodical features. It is to be understood, however, that the invention is not limited to the specific features shown described, since the means herein disclosed comprise preferred forms of putting the invention into effect. The invention is therefore, claimed in any of its forms or modifications within the proper scope of the appended claims appropriately interpreted in accordance with Doctrine of Equivalents.

I claim:

1. A container, comprising:

a first rectangularly shaped portion defined by a transparent main body which has a peripheral edge, and which consists of individually discreet first, second, and third compartments, and wherein the first portion of the container has a longitudinal and transverse axis, and wherein the first compartment is rectangular shaped and has a longitudinal axis which is substantially coaxially oriented relative to the longitudinal axis of the first portion, and wherein the second compartment is shaped like a mechanical key for operating an automobile, and which further has a longitudinal axis which is substantially parallel to the transverse axis of the first portion, and wherein the third compartment is rectangular shaped, and further has a longitudinal axis which is substantially parallel to the transverse axis of the first portion, and wherein each of the first, second and third compartments are each, individually defined by a separate, substantially continuous, and uninterrupted sidewall, and wherein the main body of the first portion also defines a circumscribing sidewall which is located in spaced relation relative to the peripheral edge, and wherein the circumscribing sidewall defines, at least in part, a circumscribing channel, and wherein a pair of coupling passageways are formed in the main body of the of the first portion, and are further located on opposite sides, and in spaced relation relative to, the second compartment which is shaped like a mechanical key for operating an automobile;

a piece of printed advertising having opposite printed sides, and which is positioned entirely within the first compartment as defined by the main body of the first rectangular shaped portion, and wherein one side of the printed advertising can be viewed through the transparent main body of the first portion;

a mechanical key for possibly operating an automobile, and which is solely positioned within the second compartment of the first portion;

a facsimile of a credit, debit or gift card which is solely positioned within the third compartment of the first portion, and wherein the piece of printed advertising, mechanical key and the facsimile of a credit debit or gift card do not come into contact with each other when received within the respective first, second and third compartments as defined by the first portion; and a second, rectangularly shaped, and transparent portion which is hingedly mounted to the first portion, and which has a main body having a peripheral edge, and wherein the main body of the second portion defines a circumscribing male engagement member which is located in spaced relation relative to the peripheral edge of the second portion, and which is further dimensioned to be matingly received within the circumscribing channel as defined by the first portion, in the manner of a releasable, friction-fit, so as to releasably couple the second portion in covering relation relative to the first portion, and wherein the printed advertising can be viewed through the transparent main body of the second portion, and wherein the second portion is moveable between a first position which permits access to the first, second and third compartments that are defined by the first portion, and a second position, where the first and second portions are disposed in a mating, closed configuration which prevents the removal of the printed advertising, mechanical key, and the facsimile of the credit, debit or gift card, and wherein the main body of the second portion further defines first second and third engagement members which are individually operable to cooperate with the first portion of the container so as to facilitate the securing of the first and second portions in releasable cooperation, together, and which further impairs any movement of the mechanical key, and the facsimile of the credit, debit or gift card, and wherein the first engagement member is dimensioned so as to matingly fit within the third compartment as defined by the first portion when the second portion is positioned in covering relation relative to the first portion, and wherein the first engagement member forcibly engages the facsimile of the credit, debit or gift card so as to inhibit excessive movement of the facsimile of the credit, debit or gift card within the third compartment, and wherein the second engagement member forcibly engages the mechanical key when the second portion is located in covering relation relative to the first portion and is operable to inhibit excessive movement of the mechanical key within the second compartment, and wherein the third engagement member comprises a pair of spaced posts which are individually received within the discreet coupling passageways which are formed in the first portion when the second portion is located in covering relation relative to the first portion, and wherein the first and second portions when releasably coupled together have a resulting thickness dimension of less than 0.25 inches, a length dimension of less than 8.65 inches, and a width dimension of less than 4.5 inches, and wherein the resulting container formed from the first and second portions can be accepted and processed by automated mail handling equipment, and delivered to a consumer by the United States Postal Service.

* * * * *